US007908953B2

(12) United States Patent
Yarborough et al.

(10) Patent No.: US 7,908,953 B2
(45) Date of Patent: Mar. 22, 2011

(54) CUTTING TOOL ATTACHED TO PACKAGE FOR WOUND LINE

(76) Inventors: John Dean Yarborough, Columbia, SC (US); David B. Skinner, Montreat, NC (US)

( * ) Notice: Subject to any disclaimer, the term of this patent is extended or adjusted under 35 U.S.C. 154(b) by 368 days.

(21) Appl. No.: 11/683,063

(22) Filed: Mar. 7, 2007

(65) Prior Publication Data

US 2008/0216327 A1 Sep. 11, 2008

(51) Int. Cl.
*B26D 1/30* (2006.01)

(52) U.S. Cl. ..... 83/607; 83/649; 83/950

(58) Field of Classification Search ..... 225/23, 225/77; 83/950, 607, 38, 649, 650, 608, 83/609; 112/295; 30/179, 190
See application file for complete search history.

(56) References Cited

U.S. PATENT DOCUMENTS

| | | | | |
|---|---|---|---|---|
| 1,454,429 | A | 5/1923 | Dresser | |
| 1,537,253 | A | 5/1925 | Miller | |
| 2,239,185 | A * | 4/1941 | Withey | 225/23 |
| 3,470,781 | A * | 10/1969 | Domeny | 83/436.9 |
| 4,111,089 | A | 9/1978 | Montaruli | |
| 4,399,729 | A | 8/1983 | Malinowski | |
| 4,606,134 | A | 8/1986 | Flick | |
| 4,978,085 | A | 12/1990 | Letourneau | |
| 5,280,741 | A | 1/1994 | Bell et al. | |
| 5,692,700 | A | 12/1997 | Bobeczko | |
| 6,494,427 | B1 | 12/2002 | Smith | |
| 6,959,635 | B2 | 11/2005 | Tramontina et al. | |
| 7,124,674 | B2 | 10/2006 | Maxey | |
| 7,150,426 | B2 | 12/2006 | Huttunen | |
| 2003/0154604 | A1 | 8/2003 | Bermes | |
| 2004/0144825 | A1 * | 7/2004 | Vandenberg | 225/23 |
| 2005/0284583 | A1 | 12/2005 | Soyad | |

FOREIGN PATENT DOCUMENTS

| | | |
|---|---|---|
| EP | 0826618 | 3/1998 |
| EP | 1118571 | 7/2001 |
| FR | 1195425 | 11/1959 |
| GB | 21553 | 12/1893 |

OTHER PUBLICATIONS

U.S. Appl. No. 11/371,509, filed Mar. 8, 2006, Yarborough, et al.

* cited by examiner

*Primary Examiner* — Kenneth E. Peterson
(74) *Attorney, Agent, or Firm* — Lawrence J. Shurupoff; Michael J. Corrigan

(57) ABSTRACT

A cutting tool for flexible line, the cutting tool being attached to the package for the flexible line, comprises a base member having a groove adapted to receive the flexible line when the cutting tool is in use and a blade recessed within the groove, the blade being adapted to cut the flexible line when the line is forced into the blade during use of the cutting tool. The cutting tool further includes an arm member in operative relationship with and complementary to the base member, which arm member is capable of producing and applying mechanical advantage in a manner that forces the flexible line received within the groove against the blade to thereby sever the flexible line.

14 Claims, 2 Drawing Sheets

FIG.-1
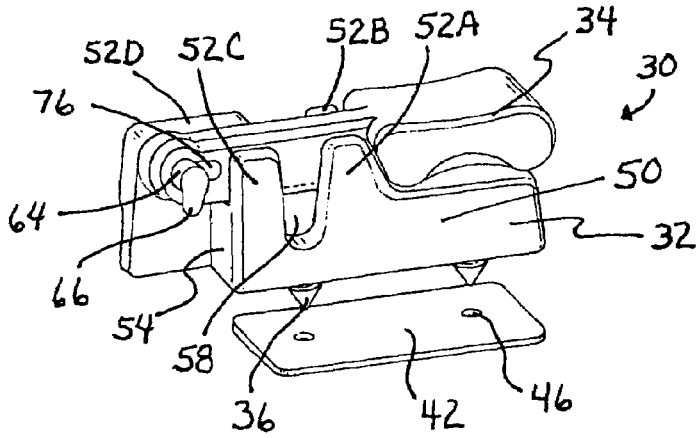
FIG.-2
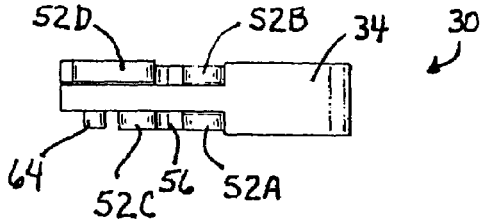
FIG.-3
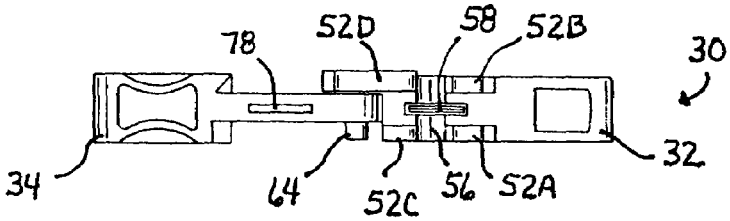
FIG.-4
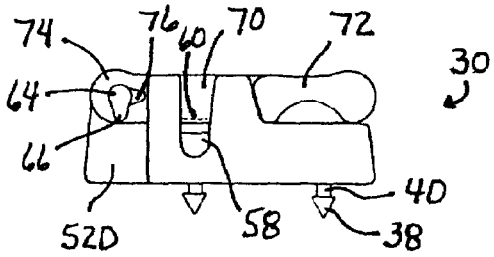
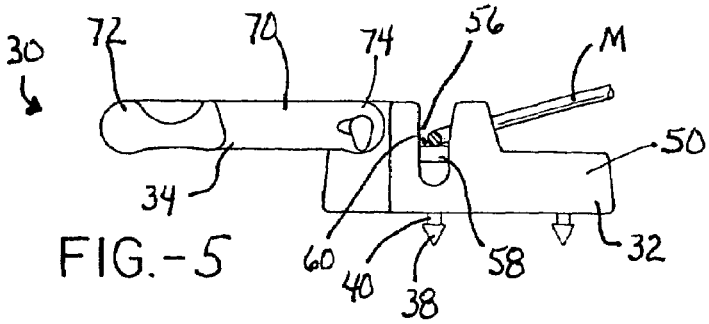
FIG.-5
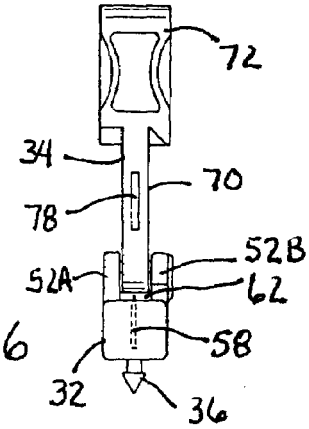
FIG.-6

CUTTING TOOL ATTACHED TO PACKAGE FOR WOUND LINE

FIELD OF THE INVENTION

The present invention relates to a cutting tool and, more particularly, to a cutting tool attached to a package for flexible wound line. Specifically, the present invention relates to a safe and effective cutting tool attached to a package for flexible wound line wherein the cutting tool produces a mechanical advantage in cutting the flexible line.

BACKGROUND OF THE INVENTION

Monofilament lines are well known in the art and are commonly defined as strings made from a single fiber. Common examples of monofilament lines include, but are not limited to, vegetation trimmer or cutting lines, pulling lines, fishing lines, and utility lines. Such monofilament lines may be made from single component filaments or from multi-component filaments, and may be produced by any of a variety of methods known in the art, including, but not limited to, molding, extruding and/or spinning. Many types of monofilament lines are made from polymeric materials.

Typically, such monofilament lines are packaged in bulk form. That is, typically, the monofilament lines are produced as continuous lines of a single or multi-component filament that are wound or otherwise placed into containers for holding the monofilament lines. As such, the task of cutting the monofilament line to a desired length of line from the package is left to the user.

Packaging for the continuous-type monofilament line can take essentially any form known in that art, but is a typically wound onto a spool or into a box or container of some type. Such containers may be of various shapes and sizes, but serve to maintain the monofilament line in an organized, wound configuration. Many containers are commonly made of plastic and may be thermoformed or molded into any shape or size desired to contain the wound monofilament line.

One such plastic container or package commonly used for vegetation trimmer line or weed cutting line is known in the industry as a "donut package" due to the general appearance of the monofilament line that is wound within the cavity of the container. The cavity of the package, as well as the monofilament line wound within it, resembles the shape of a donut.

Many vegetation trimming and weed cutting devices use monofilament line packaged in these types of containers. Previously, this winding of the monofilament line in a package may have been considered suitable for the user since many rotating string trimmers or weed cutters used most, if not all, of the spooled continuous lengths of monofilament line by winding the line onto the spool within the head of the rotary string trimmer or weed cutting apparatus. However, one trend in the area of monofilament line for a rotating string trimmer and weed cutter is the increased usage of fixed line heads, wherein only a relatively short length of line, typically about 6 to 18 inches (about 20 cm to 40 cm), are inserted into the heads of the string trimmers or weed cutting apparatuses. Thus, some manufacturers of trimmer line or weed cutting line have begun to produce pre-packaged, short strips of monofilament line pre-cut to lengths suitable for use in these newer vegetation trimmers or weed cutting apparatuses, all at greater cost to the manufacturer and/or at higher prices to the consuming public.

Thus, the need exists for ways for provide the more economical, bulk wound continuous line packages to the consuming public in a manner that will provide the user with an easy and safe means to cut the line to the lengths desired, thereby obviating the need to provide short pre-cut strips to the consuming public.

Heretofore, users of flexible wound monofilament line packaged in plastic containers have had to use auxiliary cutting devices such as, for example, knives, scissors, blades, or wire cutters, to cut the line to a desired length. The reliance on such auxiliary cutting devices is undesirable since the user, first, must possess a cutting device suitable for and capable of cutting the monofilament line and, second, must keep the cutting device close at hand or within the proximity of the user to enable the user to cut the line at a time of convenience when needed. In addition, many cutting devices, such as knives or blades, are known to be dangerous to the user due to the exposed sharp edges of these devices.

Furthermore, scissors (and even wire cutters) often do not offer the advantages that even knifes or blades may offer in cutting the line. For instance, monofilament lines having large diameters are inherently difficult to sheer with scissors, due to the toughness of the line. This is understandable given that many monofilament lines, especially those used for vegetation trimmers or weed cutters, are made to withstand and endure abrasive and sheer forces in order to provide high performance characteristics. It is known that common scissors are not strong enough or durable enough to cut the larger diameter lines. When attempting to cut a line with scissors, the line tends to slide outwardly, away from the blades of the scissors. This, in turn, causes the user of the scissors to pull on the two ends of the line so that the line is forced into the blades of the scissors. This is an unsafe action and can lead to serious bodily injury to the user, depending upon the user's use of the scissors. Moreover, pulling on the ends of the line tends to bend the line and forces the blades of the scissors to spread apart. Thus, oftentimes, scissors will not cut the larger diameter monofilament lines. Still further, scissors with plastic handles have been known to break in the user's hand, again causing bodily injury to the user.

Therefore, the need exists for a cutting tool suitable for cutting flexible wound line that can be attached to the package for the flexible wound monofilament line. The need further exists for a cutting tool that is safe and effective in cutting all polymeric monofilament lines up to at least 0.180 inches in diameter.

SUMMARY OF THE INVENTION

At least one or more of the foregoing aspects of the present invention, together with the advantages thereof over the known art relating to cutting tools and packaging, which shall become apparent from the specification and drawings that follows, are accomplished by the invention as hereinafter described and claimed The present invention provides a cutting tool attached to a package for flexible wound line. The cutting tool is adapted to cut the flexible line upon its removal from the package. The cutting tool includes a base member having a groove adapted to receive the flexible line when the cutting tool is in use and a blade recessed within the groove, the blade being adapted to cut the flexible line when the line is forced into the blade during use of the cutting tool. The cutting tool further includes an arm member acting in complementary relationship to the base member so as to produce and apply mechanical advantage in a manner that forces the flexible line received within the groove against the blade to thereby sever the flexible line.

In accordance with another embodiment, the present invention provides, in combination with a package containing flexible wound line, a cutting tool having a groove adapted to receive the flexible line upon its removal from the package and a blade adapted to cut the flexible line, the blade being recessed within the groove. The cutting tool further includes an arm member acting in complementary relationship to the base member so as to produce and apply mechanical advantage in a manner that forces the flexible line received by the groove against the blade to thereby sever the flexible line.

DESCRIPTION OF THE DRAWINGS

FIG. 1 is a perspective view of a cutting tool to be attached to a package in accordance with the present invention;

FIG. 2 is a top plan view of the cutting tool with the cutting tool closed;

FIG. 3 is a top plan view of the cutting tool with the cutting tool open;

FIG. 4 is a side plan view of the cutting tool of FIG. 2;

FIG. 5 is a side plan view of the cutting tool of FIG. 3 with a cross-sectional view of a piece of line disposed within the cutting tool;

FIG. 6 is a right end view of the cutting tool with the cutting tool partially open.

DETAILED DESCRIPTION OF THE PREFERRED EMBODIMENTS

Figure 7:
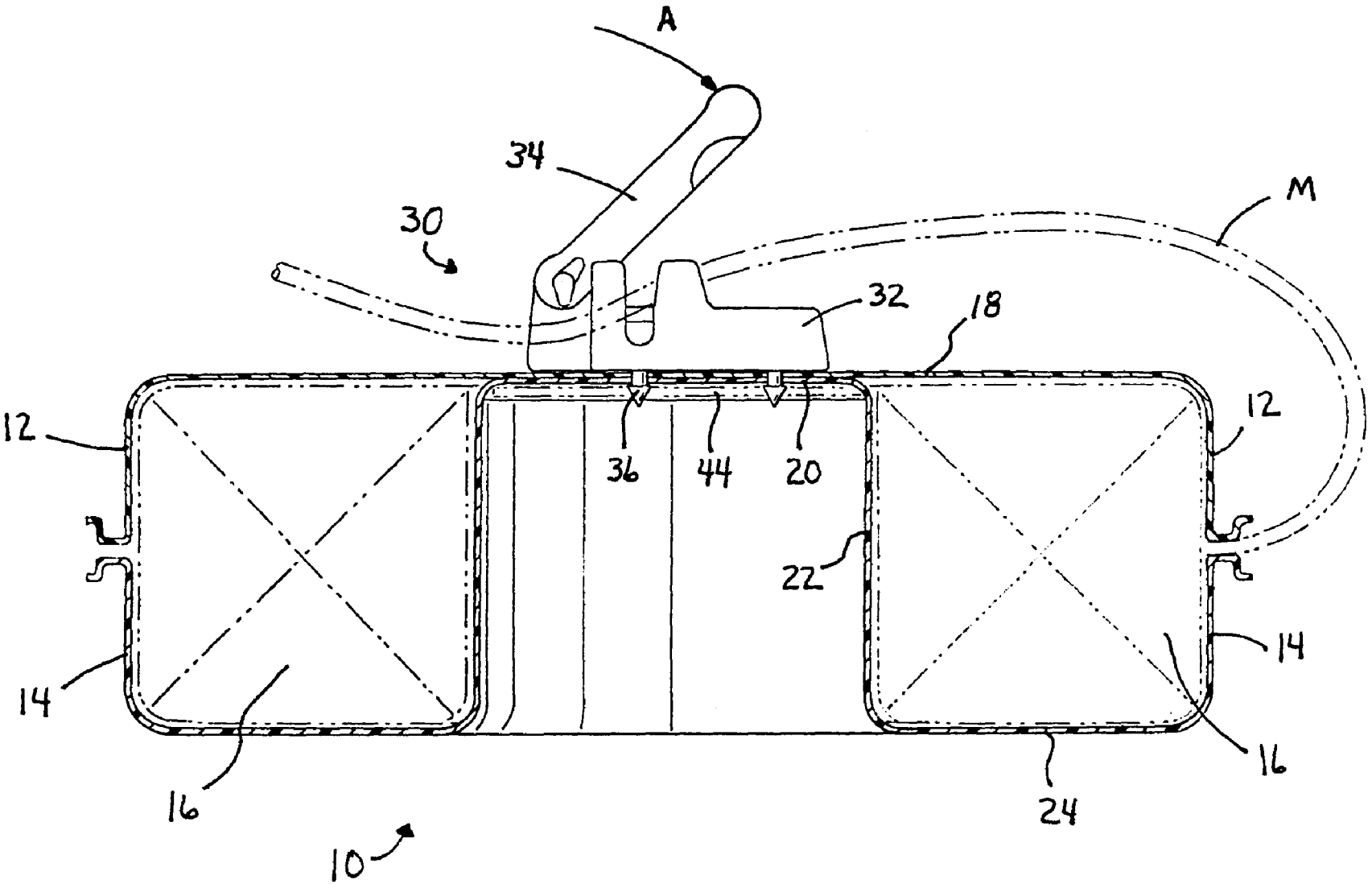
FIG. 7 is a cross-sectional view of a package having a flexible line extending therefrom and having the cutting tool attached in accordance with the present invention.

One representative form of a package embodying the concepts of the present invention is shown and generally designated by the numeral 10 in the FIG. 7, wherein the package 10 is illustrated as a plastic, thermoformed container commonly referred to in the monofilament line industry as a "donut package" inasmuch as the cavity within the package is said to resemble a donut. Such a package 10 may be made of one-piece (clamshell) or two-piece construction, wherein the package includes opposed portions 12 and 14 that generally form a housing or container defining a cavity 16 for storing flexible wound line M. Opposed portions 12 and 14 may be thermoformed, cut from pieces of material, or otherwise molded from the same mold and, thereby have the same identical shape and size, or may be cut, molded or thermoformed from different molds and, thereby, not have the same identical shape or size. In one embodiment, the opposed portions may be different such that one portion 12 is thermoformed, cut or molded with a substantially flat outer planar wall 18 radially extending from its center to its outer periphery forming the cavity 16, while the other portion 14 is thermoformed, cut or molded with a substantially indented or recessed wall 20 at its center but that extends substantially transversely, as at wall 22, and then radially outwardly, as at wall 24, to define the cavity 16 of the package 10. In one embodiment, the opposed portions 12 and 14 may be affixed together at walls 18 and 20 or near their centers to provide a spool-like effect to the package for flexible wound line M, inasmuch as the flexible line is essentially wound around the spool-like centers of the portions 12 and 14. Such packages of this type can typically hold from ⅓ to 1 pound of line.

It will be appreciated, however, that other forms of packages or containers may be used in conjunction with the concepts of the present invention, and the present invention should not be limited to the embodiments described herein and illustrated in the drawings, the breadth of the invention being determined by the scope and spirit of the attached claims. For example, the package 10 may alternatively be cut, extruded, molded or thermoformed into any desired container shape or size known in the art. The package may be made from hard plastic, thin plastic, thermoformed plastic, molded plastic, cut plastic, paper, cardboard or even may be made from metal or aluminum or combinations of any of these. Still further, the package may be made so that the monofilament line M contained therein is wound onto a spool, or may be made such that no spool is necessary for the wound line. Alternatively, the package may be made as a loop package. Loop packages typically contain 3 to 50 feet of line. In contrast, spools may be used to hold up to 5 pounds of line. Essentially any size or shape container will be suitable as the package 10 provided it can contain and store flexible wound line M as shown in the drawings. However, in one embodiment, the package is made of non-metal. In another embodiment, the package is made solely of polymeric materials.

Flexible wound line M may be essentially any line known in the art, including but not limited to, vegetation trimmer or cutting line, fishing line, pulling line, utility line, and the like. While it is preferably monofilament line, it will be appreciated that multi-filament lines, e.g., yarns, ropes, etc., may also be included as flexible wound line. Similarly, while the line is preferably polymeric, it will be appreciated that line made from non-polymeric materials, e.g., wire, cable, etc., may also be included as flexible wound line. Still further, tubing or other continuous filaments having a hollow core may also be included as flexible wound line for the purposes of this invention. However, in one embodiment, the present invention is a package containing a flexible wound line that is devoid of filaments having hollow cores. In another embodiment, the present invention is a package containing flexible wound line that is devoid of multi-filaments. And in yet another embodiment, the present invention is a package containing polymeric flexible wound line.

Advantageously, a cutting tool, designated generally by the numeral 30 in the drawings, is attached to the package 10. By the term "attached," it is meant that the cutting tool 30 may be coupled in some manner to the package, either by fastening means or connecting means. For purposes of this invention, fastening means refer to those means that directly affix the cutting tool 30 to the package 10. Examples of such fastening means include, but are not limited to, the means shown in the drawings and described in greater detail below. Other examples of fastening means may include adhesives, tapes, screws, or other fasteners that maintain and affix the cutting tool 30 directly to the package 10. In contrast, connecting means refers to those means that provide a conduit to or tie the cutting tool 30 to the package 10 in a manner that does not necessarily require that the cutting tool 30 be directly affixed to the package 10, but instead, maintains the cutting tool 30 in close proximity to the package 10. Examples of such connecting means may be a chain, a rope or string having one end tied or otherwise secured to the cutting tool 30 and the other end tied or otherwise secured to the package 10.

The cutting tool 30 may be made from any material known in the art. In one embodiment, the cutting tool in made entirely of plastic. In another embodiment, the cutting tool in molded entirely of plastic except for the blade. In yet another embodiment, the cutting tool is molded from a combination of materials, including plastic, metal and aluminum.

The cutting tool 30 of the present invention includes a base member 32 and an arm member 34 acting in complementary relationship with and, optionally, connected to the base member 32. In one embodiment of the present invention, the base member 32 is attached to the package 10. In a more specific embodiment, the base member 32 is affixed to the package 10 by fastening means. In another embodiment, the base member 32 is coupled to the package 10 by connecting means. It will be appreciated that the manner as to how the arm member 34 and base member 32 are attached depends significantly upon the relationship of the members in performing their functions as more particularly described below.

The base member 32 may take any shape and be of any size suitable for its use and positioning on the package 10, and may be made from any material known in the art. The base member 32 should preferably not be too large in size as to dwarf the package, although this would be preferred for aesthetic reasons, not necessarily for functional reasons. As shown in the drawings, one embodiment of the present invention provides that the base member 32 may be affixed to the package 10 by the use of one or more legs 36 that may be forced through at least the wall 18 of the package 10 and, if so constructed, walls 18 and 20 of the package 10. It will be appreciated that the cutting tool 30 does not have to be affixed to the package 10 where shown in FIG. 7, it being within the scope of the invention to locate the cutting tool 30 on the package 10 essentially anywhere it is desired and practical.

In some embodiments, package 10 may have puncture points (not shown) prefabricated into them for ease of forcing the legs 36 through the package wall. In other embodiments, the legs 36 may be formed and take a shape suitable for puncturing the wall of the package without prior manipulation of the package wall. For example, as shown, each leg 36 may be shaped with a pointed conical end 38 that extends from a narrower, cylindrical body 40, such that, upon pressing the pointed conical end 38 through the wall of the package, the wall is captured between the fatter side of the conical end and the bottom of the base member. The resiliency and strength of the plastic wall and the design of the leg 36 prevents removal of the leg 36 from the wall once positioned through the package 10. Nevertheless, care should be taken so as to not rupture or tear the package beyond that necessary for securing the legs 36 of the base member 32 through the package 10.

In at least one embodiment, the legs 36 may be adequate to secure the cutting tool 30 to the package 10. In other embodiments where the package walls are extremely thin, it may be desirable to ensure the security of the cutting tool 30 to the package 10 by means of a securing strap 42 adapted to receive the legs 36 of the cutting tool 30 after it has passed through the package wall. The strap 42 may be made of any rigid material known in the art and may take any shape desired provided it fits within the parameters of the package 10. In one embodiment, the strap 42 is a rigid but flexible and resilient band of plastic, metal or aluminum, and has apertures 46 adapted to receive the legs 36 of base member 32 from cutting tool 30. Like the package wall, the strap 42 is flexible and resilient enough, and the apertures small enough, to allow the conical end 38 of the leg 36 to be forced through the aperture 46 and capture it between the fatter side of the conical end and the package wall. If necessary, in order to provide further strength to the package wall, the package wall may have a prefabricated ridge 44. Likewise, the strap 42 may have a complementary ridge (not shown) adapted to be congruent with the ridge 44 of the package 10.

In the embodiment shown in the drawings, base member 32 has an elongated body portion 50 with four prongs 52A, 52B, 52C and 52D extending upwardly proximate to one end 54 of the base member 32. The void between the first pair of prongs 52A and 52C and between the second pair of prongs 52B and 52D define a groove 56 in the base member 32, which groove 56 is substantially orthogonal to the axis of the elongated body portion 50 of the base member 32. Within the groove, a blade 58 is adapted to be received with a cutting edge 60 facing upwards toward the arm member 34.

Similarly, there may be a void between prongs 52A and 52B and between prongs 52C and 52D that define a recess 62 extending transverse to the groove 56 and adapted for receiving the arm member 34 upon closing of the arm member 34 against base member 32 as described below. The recess 62 does not extend significantly deep into the body portion 50 of the base member 32, being defined generally by the height of the extended prongs 52A-D. However, the depth of the groove 56 is deeper than the depth of the recess 62 and may extend into body portion 50. This depth of the groove 56 enables the blade 58 to be positioned in line with the recess 62, transversely within the groove 56 and essentially parallel to the axis of the elongated body portion 50 such that the cutting edge 60 of the blade 58 does not rise significantly above the height of the body portion 50 within the recess 62. Accordingly, it will be appreciated that the blade 58 and, particularly, the cutting edge 60 of the blade is not accessible to the hands or fingers of the user, providing for a safer use of the cutting tool.

In an embodiment of the invention as shown in the drawings, prong 52D may be substantially elongated so as to extend further than end 54 of the base member 32. By elongating prong 52D, a connecting pin 64 may be provided on the prong that extends inwardly across the axis of the base member 32. Connecting pin 64 may be generally cylindrical in shape and may include a tooth 66 proximate its extended end. Connecting pin 64 is one means by which arm member 34 may be connected to base member 32. It will be appreciated that any connecting means known in the art may be used to operatively connect arm member 34 to base member 32, the embodiment shown being just one example of such means.

The arm member 34 may take any shape and be of any size suitable for use in complementary operation with the base member 32. Like the base member, the arm member 34 preferably should not be too large in size as to dwarf the package or the base member, although this would be preferred for aesthetic reasons, not necessarily for functional reasons. In one embodiment as shown in the drawings, the arm member 34 may be elongated and have a work portion 70 positioned between an elongated handle or gripping portion 72 at one end of the arm member 34 for moving the arm member 34, and a connecting portion 74 on the other end of the arm member 34, for operatively engaging the arm member 34 with the base member 32. The arm member 34 may be of one-piece construction or each portion may be made from different pieces and/or materials. In one embodiment, the working portion 70 may include a slit 78 for receiving a portion of the blade 58 when the arm member 58 is closed. The work portion 70 of the arm member 34 contacts the flexible line disposed in the groove 56 when rotated toward the closed position thereby forcing the flexible line against the cutting edge 60 of the line cutting blade 58 and cutting the flexible line. The cutting edge 60 of the line cutting blade 58 is forced to pass completely through the flexible line and into the slit 78 of the work portion 70 when the arm member 34 is moved to the closed position. The handle portion 72 may be shaped in any manner known in the art and, in at least one embodiment, may be shaped for easy gripping by the user's hand or fingers. The work portion 70 may also be shaped in any manner known in the art but should be operative with the base member 32 in a manner that will allow for the cutting of flexible line by the blade 58 as further described below. The connecting portion 74 may include an opening 76 adapted to receive the connecting pin 64 of the base member 32, to permit the rotation of the arm member 34 around the connecting pin 64. In one embodiment as shown in the drawings, the opening 76 is essentially circular to allow relatively smooth operation and rotation of the arm member 34, but includes an extended opening to permit the tooth 66 of the connecting pin 64 through the opening 76 when the arm member 34 is rotated to a releasing position. That is, the arm member 34 may be adapted to be connected to or released from the base member 32 by placing the opening 76 of the arm member 34 in congruent alignment with the connecting pin 64 and its tooth 66 and passing the tooth 66 through the opening 76. Then, by rotating the arm member 34 to a working position, the tooth will have locked or otherwise secured the arm member 34 to the base member 32.

The cutting tool 30 is to be utilized by the user of the flexible line to cut the flexible line M contained in the package 10 to a desired length for further use of that length of line. Thus, upon pulling a length of the line M from the package 10, the user will rotate the arm member 34 to an open position to allow access to the groove 56 in the base member 32. The user will then position the line M into the groove 56 of the base member 32 above the blade 58 where it is desired that the line M is to be cut. In one embodiment, the groove 56 is of sufficient width to provide for the cutting of flexible line measuring up to at least 0.180 inches in diameter. In another embodiment, a groove may accommodate the cutting of monofilament line ranging from about 0.010 inches to about 0.180 inches in diameter.

It will further be appreciated that any length of line may be cut. Therefore, if a short (about 6 to 18 inches) strip of monofilament line is desired for use in a fixed line head of a vegetation trimmer, then such a short strip can be cut. On the other hand, if the user desires a long length of line such is often the case with spooled line heads of vegetation trimmers, then a much longer length of line can be cut.

The groove 56, therefore, includes not only the blade 58, but is also adapted to receive the flexible line M to be cut. In at least one embodiment, the groove 56 is adapted to prevent movement of the of the line perpendicular to the direction of the cutting action. In another embodiment, the groove 56 prevents movement of the line in any direction other than in the direction of the blade, thereby holding the line in place during use of the cutting tool 30.

Once the flexible line M is positioned in the groove 56, the arm member 34 may then be rotated in the direction of arrow A toward the closed position. The work portion 70 of the arm member 34 will then contact the flexible line M, forcing the line M against the cutting edge 60 of the blade 58 and cutting the line M.

Notably, the cutting tool advantageously uses mechanical advantage to assist in the cutting of the line M. Due to the construction of the cutting tool 30, and the placement of the line M and blade 58 relative to the pressing of the user's hand or fingers on the arm member and the connection point between the arm member and the base member, only a relatively small force is required by the user to create a much greater force on the line to cut it. This is because the input distance the user has to move the arm member is greater than the output distance the line has to move in order to be cut. This is the simple principal known as the Law of Conservation of Energy (work in equals work out), wherein work equals force times distance. Thus the input force (F1) times the input distance (D1) has to equal the output force (F2) times the output distance (D2). Where, as here, the input distance (D1) is greater than the output distance (D2), the amount of input force (F1), i.e., the user's hand or fingers, is much less than the amount of output force (F2), i.e., the force applied to the line by the work portion 70 of the arm member 34.

As shown in the drawings, the groove 56 and, thereby, the line M to be cut, is closer to the fulcrum, the point around which the arm member rotates, i.e., the connecting pin 64. In fact, the groove 56 is located between the fulcrum (connecting pin 64 and the effort force applied by the user. As such, this may be considered a second-class lever mechanism. Since the fulcrum is located closer to the resistance, i.e., the line M to be cut, than to the applied force, i.e., the pressing force made by the user, an increase in force (i.e., a mechanical advantage) at the groove 56 results.

It will be appreciated that other forms and shapes of the arm member 34 can be made that will enable the arm member to apply and produce mechanical advantage. For instance, a first class lever mechanism can be created by moving the fulcrum, i.e., the connecting pin 64, to a position between the groove 56 and the end of the arm member 34 where the force applied by the user will be, and maintaining the connecting pin 64 closer to the groove 56.

In other embodiments of the present invention, mechanical advantage may be created and applied by use of a wedge as the arm member. In one embodiment, the wedge would be slidable on and/or slidably connected to the base member, with the thinnest part of the sloped surface of the wedge resting proximate the line M held in groove 56 between the blade 58 and the wedge. If the blade is positioned below the line M, one may consider this to be an incline plane turned upside down. Alternatively, if the blade is positioned above the line, one may consider this to be a wedge with an upward slanting slope. In either event, the user would apply force to move the wedge toward the groove over a distance, thereby causing the sloped surface of the wedge to engage the line M and force it upward or downward onto the blade as a larger and larger portion of the wedge slides over the groove. Mechanical advantage is produced and applied because the distance the wedge is forcibly moved by the user is greater than the distance the line is moved into the blade. In at least one embodiment, the wedge may have fastening means for slidably engaging the base member and insuring that the wedge does not move upward (or downward) as it moves across the groove.

In still another embodiment, mechanical advantage may be created and applied by use of a screw as the arm member. The screw would be positioned over the groove in a manner such that as the user turns the screw tighter against the line M in the groove, the blade would cut the line M. That is, because the screw rotates a greater distance in terms of rotation than the distance the screw moves the line into the blade, mechanical advantage is produced and applied. Fastening means for maintaining the screw in position over the groove and for maintaining the position of the screw relative to the base member would also be provided.

Thus, it will be appreciated that several alternative embodiments and structural equivalents of the cutting tool are contemplated that enables the cutting tool 30 to produce and apply mechanical advantage to the components of the tool in cutting the line M. In each instance, however, an arm member, acting in complementary relationship with the base member, is used to create and apply the mechanical advantage.

In light of the foregoing, it should thus be evident that the present invention substantially improves the art of cutting tools for flexible line, and provides particular advantages for handling and cutting flexible line. While a full and complete description of the invention has been set forth in accordance with the dictates of the patent statutes, it should be understood that modifications can be resorted to without departing from the spirit hereof or the scope of the appended claims.

What is claimed is:

1. A combination of a package containing flexible line and a cutting tool attached to the package adapted for cutting the flexible line, comprising:

a package having a cavity configured to maintain the flexible line in a coil wherefrom the flexible line is dispensed, said package substantially encasing the flexible line and having at least one sidewall adjacent to and parallel to a plane of the coil, said plane being perpendicular to a direction of an axis of rotation of the flexible line when the flexible line is being dispensed; and a cutting tool attached to the at least one sidewall such that the cutting tool is disposed adjacent to the coil, the cutting tool comprising:

a base comprising a first pair of prongs and a second pair of prongs, said first and second pairs of prongs defining a groove in said base and a recess extending transverse to said groove;

said groove configured to receive and locate a portion of the flexible line;

a line cutting blade carried by said base, said line cutting blade fixed in position between said first and second pairs of prongs and aligned with said recess; and an arm member movable within said recess, wherein the arm member is pivotally connected to the base, said arm member having a blade receiving portion for co-acting with said cutting blade to cut the flexible line.

2. The combination of claim 1, wherein the base member is affixed to the sidewall of the package by fastening means.

3. The combination of claim 2, wherein the base member is affixed to the sidewall of the package by legs secured through the sidewall of the package.

4. The combination of claim 1, wherein the base member is coupled to the sidewall of the package by connecting means.

5. The combination of claim 1, wherein the groove can accommodate a line having a diameter of up to at least 0.180 inches.

6. The combination of claim 5, wherein the groove can accommodate a line having a diameter ranging from about 0.01 inches to about 0.180 inches.

7. The combination of claim 1, wherein the blade is not accessible to a user's hands or fingers.

8. The combination of claim 7, wherein the arm member includes a handle for moving the arm member and a connecting portion for connecting the arm member to the base member, wherein the connecting portion is proximate the groove and the blade, and distal from the handle.

9. The combination of claim 8, wherein the arm member includes said blade receiving portion proximate the connecting portion and distal from the handle, and wherein the arm member produces and applies mechanical advantage by moving the handle a greater distance than the distance the blade receiving portion is moved.

10. The combination of claim 8, wherein the arm member includes said blade receiving portion between the handle and the connecting portion, and where the arm member produces and applies mechanical advantage by moving the handle a greater distance than the distance the blade receiving portion is moved.

11. The combination of claim 10, wherein said blade receiving portion includes a slit configured to receive a cutting edge of the line cutting blade when the arm member is moved to a closed position.

12. The combination of claim 11, wherein the blade receiving portion of the arm member contacts the flexible line when rotated toward the closed position thereby forcing the flexible line against the cutting edge of the line cutting blade and cutting the flexible line, the cutting edge of the line cutting blade being forced to pass completely through the flexible line and into the slit of the blade receiving portion when the arm member is moved to the closed position.

13. The combination of claim 1, wherein the arm member and the base member are plastic.

14. The combination of claim 1, wherein the arm member is connected to the base member via a connecting pin prior to the base member being affixed to the package, and a tooth on the connecting pin locks the arm member onto the connecting pin after the base member has been affixed to the package.

* * * * *